US010590774B2

(12) United States Patent
Chouhan et al.

(10) Patent No.: US 10,590,774 B2
(45) Date of Patent: Mar. 17, 2020

(54) TURBINE BUCKET FOR CONTROL OF WHEELSPACE PURGE AIR

(71) Applicant: General Electric Company, Schenectady, NY (US)

(72) Inventors: Rohit Chouhan, Bangalore (IN); Soumyik Kumar Bhaumik, Bangalore (IN)

(73) Assignee: General Electric Company, Schenectady, NY (US)

( * ) Notice: Subject to any disclaimer, the term of this patent is extended or adjusted under 35 U.S.C. 154(b) by 196 days.

(21) Appl. No.: 14/603,321

(22) Filed: Jan. 22, 2015

(65) Prior Publication Data

US 2016/0215626 A1 Jul. 28, 2016

(51) Int. Cl.

| | |
|---|---|
| ***F01D 5/14*** | (2006.01) |
| ***F01D 5/08*** | (2006.01) |
| ***F01D 11/00*** | (2006.01) |

(52) U.S. Cl.

CPC ..... *F01D 5/147* (2013.01); *F01D 5/08* (2013.01); *F01D 5/081* (2013.01); *F01D 5/082* (2013.01); *F01D 5/085* (2013.01); *F01D 5/087* (2013.01); *F01D 5/14* (2013.01); *F01D 11/001* (2013.01); *F01D 11/006* (2013.01); *F05D 2220/32* (2013.01); *F05D 2240/30* (2013.01); *F05D 2240/55* (2013.01); *F05D 2240/80* (2013.01); *F05D 2250/12* (2013.01); *F05D 2250/14* (2013.01)

(58) Field of Classification Search

CPC ..... F01D 11/001; F01D 11/006; F01D 5/14; F01D 5/147; F01D 5/087; F01D 5/082; F01D 5/085; F01D 5/08; F05D 2220/32

See application file for complete search history.

(56) References Cited

U.S. PATENT DOCUMENTS

| | | | | |
|---|---|---|---|---|
| 5,211,533 A | | 5/1993 | Walker et al. | |
| 5,417,545 A | * | 5/1995 | Harrogate | F01D 5/186 415/115 |
| 5,893,984 A | * | 4/1999 | Thompson | B23H 9/10 219/69.15 |

(Continued)

FOREIGN PATENT DOCUMENTS

| | | |
|---|---|---|
| DE | 10 2006 043 744 A1 | 3/2007 |
| EP | 1 895 108 A2 | 3/2008 |

(Continued)

OTHER PUBLICATIONS

European Search Report and Opinion in relation to U.S. Appl. No. 14/603,316 (GEEN-0561) dated Jun. 28, 2016, 7 pages.

(Continued)

*Primary Examiner* — Dwayne J White

*Assistant Examiner* — Danielle M. Christensen

(74) *Attorney, Agent, or Firm* — Dale Davis; Hoffman Warnick LLC

(57) ABSTRACT

Embodiments of the invention relate generally to rotary machines and, more particularly, to the control of wheel space purge air in gas turbines. In one embodiment, the invention provides a turbine bucket comprising: a platform portion; an airfoil extending radially outward from the platform portion; a platform lip extending axially from the platform portion; and a plurality of voids disposed along a surface of the platform lip.

7 Claims, 9 Drawing Sheets

(56) References Cited

U.S. PATENT DOCUMENTS

| | | | | |
|---|---|---|---|---|
| 6,077,035 | A | 7/2000 | Walters et al. | |
| 6,783,323 | B2 | 8/2004 | Shiozaki et al. | |
| 7,044,710 | B2 | 5/2006 | Naik et al. | |
| 7,114,339 | B2 | 10/2006 | Alvanos et al. | |
| 7,189,055 | B2 | 3/2007 | Marini et al. | |
| 7,189,056 | B2 | 3/2007 | Girgis et al. | |
| 7,244,104 | B2 | 7/2007 | Girgis et al. | |
| 7,665,964 | B2 | 2/2010 | Taylor et al. | |
| 8,057,178 | B2 * | 11/2011 | Itzel | F01D 5/186 416/96 R |
| 8,083,475 | B2 | 12/2011 | Bulgrin et al. | |
| 8,186,952 | B2 | 5/2012 | Tibbott | |
| 8,419,356 | B2 * | 4/2013 | Little | F01D 11/001 415/173.1 |
| 8,834,122 | B2 | 9/2014 | Ingram | |
| 8,939,711 | B2 | 1/2015 | Lee et al. | |
| 8,979,481 | B2 | 3/2015 | Ingram | |
| 9,039,357 | B2 * | 5/2015 | Lee | F01D 11/001 415/171.1 |
| 9,121,298 | B2 | 9/2015 | Lee et al. | |
| 2006/0269399 | A1 * | 11/2006 | Girgis | F01D 5/081 415/115 |
| 2010/0074733 | A1 | 3/2010 | Little | |
| 2012/0163955 | A1 | 6/2012 | Devi et al. | |
| 2012/0251291 | A1 | 10/2012 | Ledezma et al. | |
| 2013/0108441 | A1 * | 5/2013 | Ingram | F01D 11/04 416/1 |
| 2013/0108451 | A1 | 5/2013 | Ingram | |
| 2013/0170983 | A1 | 7/2013 | Babu et al. | |
| 2013/0205794 | A1 * | 8/2013 | Xu | F01D 5/186 60/754 |
| 2013/0302141 | A1 | 11/2013 | Quach et al. | |
| 2014/0003919 | A1 | 1/2014 | Lee et al. | |
| 2014/0147250 | A1 | 5/2014 | Lee et al. | |
| 2014/0205443 | A1 | 7/2014 | Lee et al. | |
| 2014/0234076 | A1 * | 8/2014 | Lee | F01D 11/001 415/116 |
| 2014/0271111 | A1 | 9/2014 | Ballard, Jr. et al. | |
| 2014/0286760 | A1 | 9/2014 | Lee | |

FOREIGN PATENT DOCUMENTS

| | | | |
|---|---|---|---|
| EP | 2 116 692 | A2 | 11/2009 |
| EP | 2581555 | A1 | 4/2013 |
| EP | 2586995 | A2 | 5/2013 |
| EP | 2586996 | A2 | 5/2013 |
| GB | 2251040 | A | 6/1992 |
| JP | 2004100578 | A | 4/2004 |
| WO | 2011029420 | A1 | 3/2011 |

OTHER PUBLICATIONS

European Search Report and Opinion in relation to U.S. Appl. No. 14/603,321 (GEEN-0559) dated Jun. 28, 2016, 6 pages.
European Search Report and Opinion in related to U.S. Appl. No. 14/635,352 (GEEN-0556), dated Jul. 12, 2016, 8 pages.
U.S. Appl. No. 14/635,352, Office Action 1 dated Mar. 9, 2017, (GEEN-0556-US), 42 pages.
U.S. Appl. No. 14/603,314, Office Action 1 dated Mar. 24, 2017, (GEEN-0558-US), 40 pages.
U.S. Appl. No. 14/603,316, Office Action1 dated May 31, 2017, (GEEN-0561-US), 39 pages.
U.S. Appl. No. 14/603,318, Office Action 1 dated Jun. 18, 2017, (GEEN-0560-US), 26 pages.
U.S. Appl. No. 15/217,212, Office Action 1 dated Jul. 3, 2017, (GEEN-0819-CIP), 16 pages.
U.S. Appl. No. 14/603,314, Final Office Action 1 dated Jul. 13, 2017, (GEEN-0558-US), 17 pages.
U.S. Appl. No. 14/635,352, Office Action 2 dated Sep. 13, 2017, (GEEN-0556-US), 12 pages.
Chouhan et al., filed Jan. 22, 2015, U.S. Appl. No. 14/603,318.
Chouhan et al., filed Jan. 22, 2015, U.S. Appl. No. 14/603,316.
Chouhan et al., filed Jul. 22, 2016, U.S. Appl. No. 15/216,881.
Chouhan et al., filed Jan. 22, 2015, U.S. Appl. No. 14/603,314.
Chouhan et al., filed Sep. 7, 2016, U.S. Appl. No. 15/257,986.
Chouhan et al., filed Jul. 22, 2016, U.S. Appl. No. 15/217,212.
Extended European Search Report and Opinion issued in connection with related EP Application No. 16152213.1 dated Dec. 21, 2016.
U.S. Appl. No. 14/603,316, Final Office Action 1 dated Sep. 15, 2017, (GEEN-0561-US), 24 pages.
U.S. Appl. No. 14/603,318, Final Office Action 1 dated Nov. 27, 2017, (GEEN-0560-US), 15 pages.
U.S. Appl. No. 14/635,352, Final Office Action 1 dated Dec. 6, 2017, (GEEN-0556-US), 13 pages.
U.S. Appl. No. 15/217,212, Office Action 2 dated Dec. 14, 2017, (GEEN-0819-CIP), 14 pages.
U.S. Appl. No. 14/603,314, Office Action dated Dec. 29, 2017, (GEEN-0558-US), 27 pages.
U.S. Appl. No. 14/635,352, Final Office Action dated Jun. 29, 2018, (GEEN-0556-US), 8 pages.
U.S. Appl. No. 14/635,352, Office Action dated Mar. 29, 2018, (GEEN-0556-US), 14 pages.
U.S. Appl. No. 14/603,314, Final Office Action dated Apr. 3, 2018, (GEEN-0558-US), 13 pages.
U.S. Appl. No. 14/603,318, Office Action dated Apr. 3, 2018, (GEEN-0560-US), 12 pages.
U.S. Appl. No. 15/217,212, Final Office Action dated Apr. 5, 2018, (GEEN-0819-CIP), 14 pages.
Office Action and English Translation thereof for Chinese Patent Application No. 201610116856.4 dated Dec. 24, 2018, 15 pages.
U.S. Appl. No. 14/603,318, Final Office Action dated Sep. 7 2018, (GEEN-0560-US), 19 pages.
U.S. Appl. No. 15/217,212, Office Action dated Sep. 20, 2018, (GEEN-0819-CIP), 16 pages.
U.S. Appl. No. 14/603,314, Office Action dated Sep. 27, 2018, (GEEN-0558-US), 16 pages.
U.S. Appl. No. 15/216,881, Office Action dated Nov. 29, 2018, (GEEN-0561-CIP), 9 pages.
U.S. Appl. No. 15/216,881, Final Office Action dated Apr. 4, 2019, (GEEN-0561-CIP), 9 pages.
U.S. Appl. No. 15/217,212, Final Office Action dated Apr. 12, 2019, (GEEN-0819-CIP), 9 pages.
U.S. Appl. No. 14/603,314, Final Office Action dated May 1, 2019, (GEEN-0558-US), 10 pages.
U.S. Appl. No. 14/603,316, Notice of Allowance dated May 21, 2019, (GEEN-0561-US), 8 pages.
U.S. Appl. No. 15/216,881, Office Action dated Jul. 18, 2019, (GEEN-0561-CIP), 16 pages.
U.S. Appl. No. 14/603,316, Office Action dated Sep. 12, 2019, (GEEN-0561-US), 14 pages.
U.S. Appl. No. 15/216,881, Office Action 2 dated Sep. 26, 2019, (GEEN-0561-CIP), 9 pages.
U.S. Appl. No. 15/217,212, Office Action dated Oct. 2, 2019, (GEEN-0819-CIP), 8 pages.
U.S. Appl. No. 14/603,314, Notice of Allowance dated Oct. 2, 2019, (GEEN-0558-US), 8 pages.
U.S. Appl. No. 15/217,212, Final Office Action dated Jan. 24, 2020, 8 pages.
U.S. Appl. No. 14/603,316 Notice of Allowance dated Dec. 20, 2019, 17 pages.
U.S. Appl. No. 15/216,881, Notice of Allowance dated Dec. 20, 2019, 17 pages.

* cited by examiner

TURBINE BUCKET FOR CONTROL OF WHEELSPACE PURGE AIR

BACKGROUND OF THE INVENTION

Embodiments of the invention relate generally to rotary machines and, more particularly, to the control of wheel space purge air in gas turbines.

As is known in the art, gas turbines employ rows of buckets on the wheels/disks of a rotor assembly, which alternate with rows of stationary vanes on a stator or nozzle assembly. These alternating rows extend axially along the rotor and stator and allow combustion gasses to turn the rotor as the combustion gasses flow therethrough.

Axial/radial openings at the interface between rotating buckets and stationary nozzles can allow hot combustion gasses to exit the hot gas path and radially enter the intervening wheelspace between bucket rows. To limit such incursion of hot gasses, the bucket structures typically employ axially-projecting angel wings, which cooperate with discourager members extending axially from an adjacent stator or nozzle. These angel wings and discourager members overlap but do not touch, and serve to restrict incursion of hot gasses into the wheelspace.

In addition, cooling air or "purge air" is often introduced into the wheelspace between bucket rows. This purge air serves to cool components and spaces within the wheelspaces and other regions radially inward from the buckets as well as providing a counter flow of cooling air to further restrict incursion of hot gasses into the wheelspace. Angel wing seals therefore are further designed to restrict escape of purge air into the hot gas flowpath.

Nevertheless, most gas turbines exhibit a significant amount of purge air escape into the hot gas flowpath. For example, this purge air escape at the first and second stage wheelspaces may be between 0.1% and 3.0%. The consequent mixing of cooler purge air with the hot gas flowpath results in large mixing losses, due not only to the differences in temperature but also to the differences in flow direction or swirl of the purge air and hot gasses.

BRIEF DESCRIPTION OF THE INVENTION

In one embodiment, the invention provides a turbine bucket comprising: a platform portion; an airfoil extending radially outward from the platform portion; a platform lip extending axially from the platform portion; and a plurality of voids disposed along a surface of the platform lip.

In another embodiment, the invention provides a turbine bucket comprising: a platform portion; an airfoil extending radially outward from the platform portion; a platform lip extending axially from the platform portion; and a plurality of voids disposed along a surface of the platform lip, each of the plurality of voids extending radially through a body of the platform lip.

BRIEF DESCRIPTION OF THE DRAWINGS

These and other features of this invention will be more readily understood from the following detailed description of the various aspects of the invention taken in conjunction with the accompanying drawings that depict various embodiments of the invention, in which.

It is noted that the drawings of the invention are not to scale. The drawings are intended to depict only typical aspects of the invention, and therefore should not be considered as limiting the scope of the invention. In the drawings, like numbering represents like elements among the drawings.

DETAILED DESCRIPTION OF THE INVENTION

Figure 1:
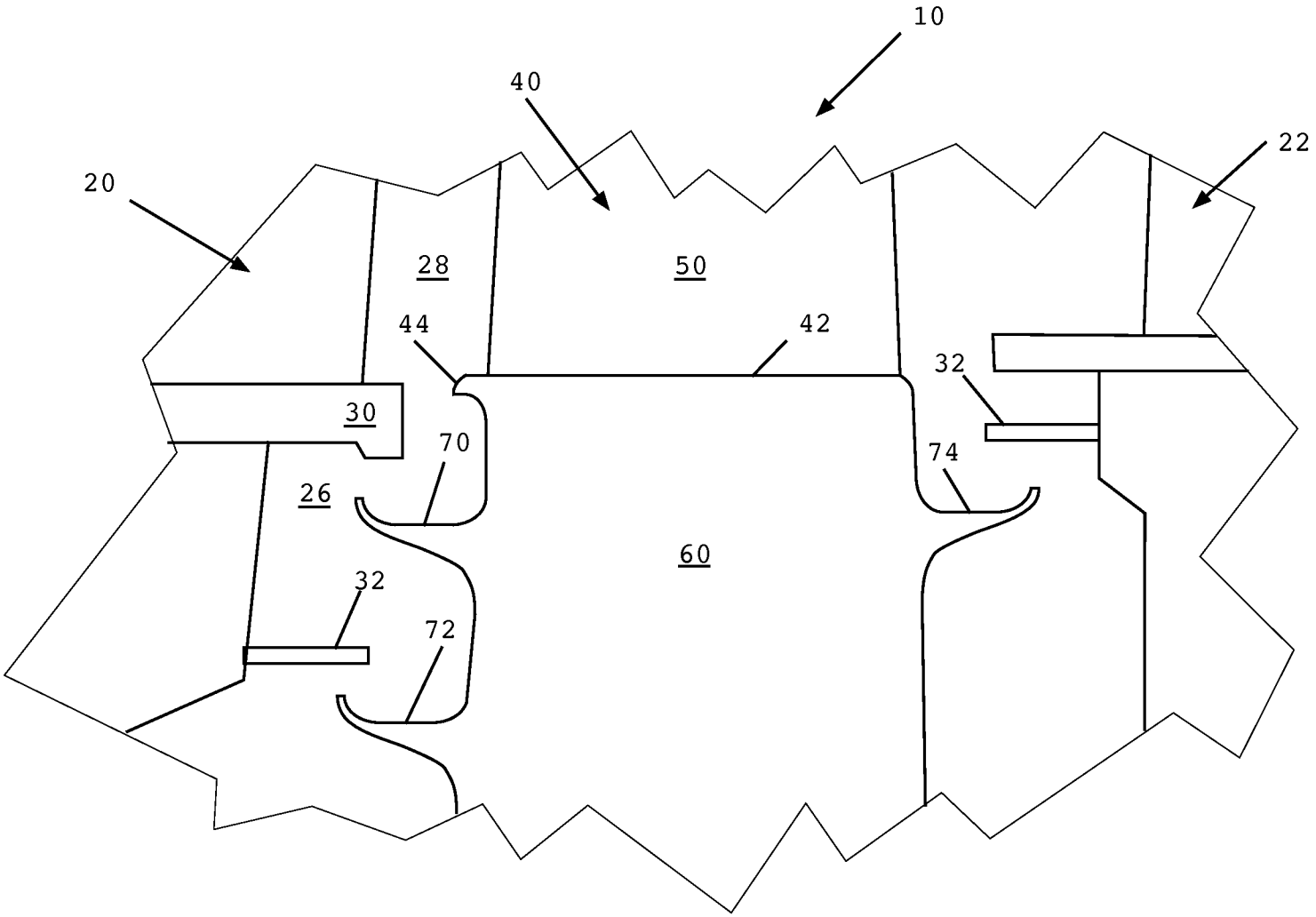
FIG. 1 shows a schematic cross-sectional view of a portion of a known turbine.

Turning now to the drawings, FIG. 1 shows a schematic cross-sectional view of a portion of a gas turbine 10 including a bucket 40 disposed between a first stage nozzle 20 and a second stage nozzle 22. Bucket 40 extends radially outward from an axially extending rotor (not shown), as will be recognized by one skilled in the art. Bucket 40 comprises a substantially planar platform 42, an airfoil extending radially outward from platform 42, and a shank portion 60 extending radially inward from platform 42.

Shank portion 60 includes a pair of angel wing seals 70,72 extending axially outward toward first stage nozzle 20 and an angel wing seal 74 extending axially outward toward second stage nozzle 22. It should be understood that differing numbers and arrangements of angel wing seals are possible and within the scope of the invention. The number and arrangement of angel wing seals described herein are provided merely for purposes of illustration.

As can be seen in FIG. 1, nozzle surface 30 and discourager member 32 extend axially from first stage nozzle 20 and are disposed radially outward from angel wing seals 70 and 72, respectively. As such, nozzle surface 30 overlaps but does not contact angel wing seal 70 and discourager member 32 overlaps but does not contact angel wing seal 72. A similar arrangement is shown with respect to discourager member 32 of second stage nozzle 22 and angel wing seal 74. In the arrangement shown in FIG. 1, during operation of the turbine, a quantity of purge air may be disposed between, for example, nozzle surface 30, angel wing seal 70, and platform lip 44, thereby restricting both escape of purge air into hot gas flowpath 28 and incursion of hot gasses from hot gas flowpath 28 into wheelspace 26.

While FIG. 1 shows bucket 40 disposed between first stage nozzle 20 and second stage nozzle 22, such that bucket 40 represents a first stage bucket, this is merely for purposes of illustration and explanation. The principles and embodiments of the invention described herein may be applied to a bucket of any stage in the turbine with the expectation of achieving similar results.

Figure 2:
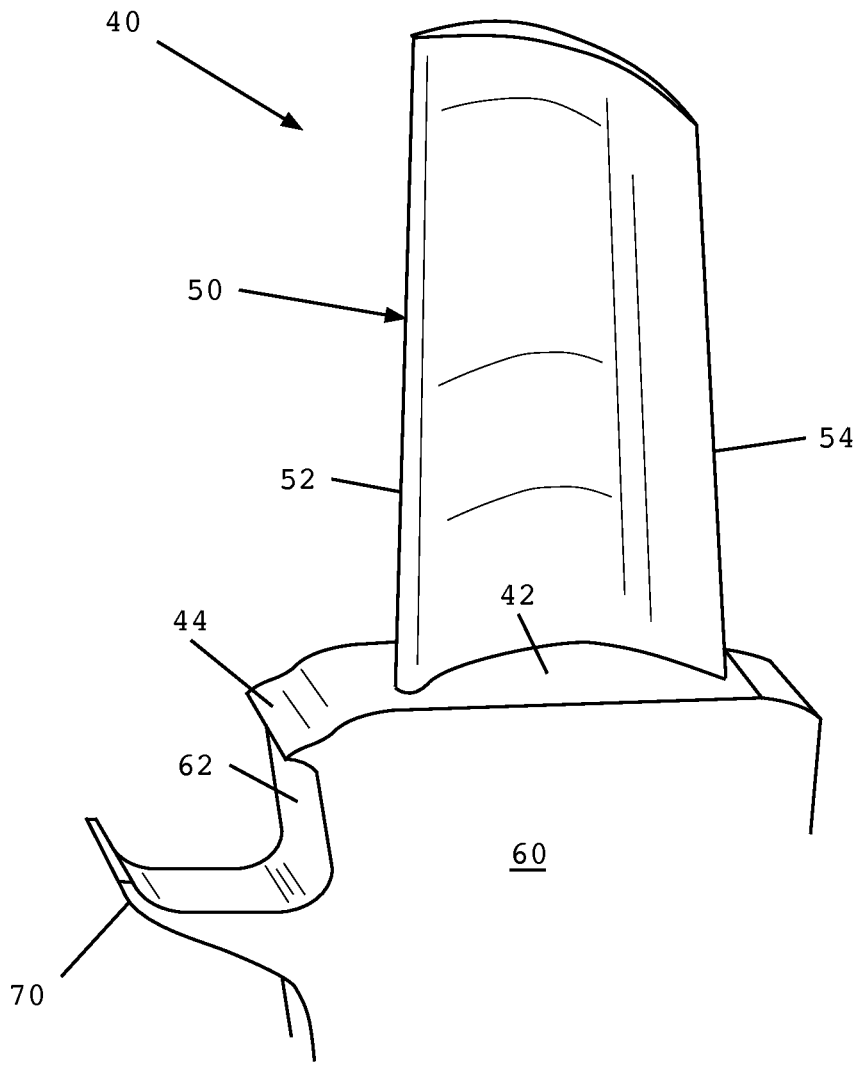
FIG. 2 shows a perspective view of a known turbine bucket.

FIG. 2 shows a perspective view of a portion of bucket 40. As can be seen, airfoil 50 includes a leading edge 52 and a trailing edge 54. Shank portion 60 includes a face 62 nearer leading edge 52 than trailing edge 54, disposed between angel wing 70 and platform lip 44.

Figure 3:
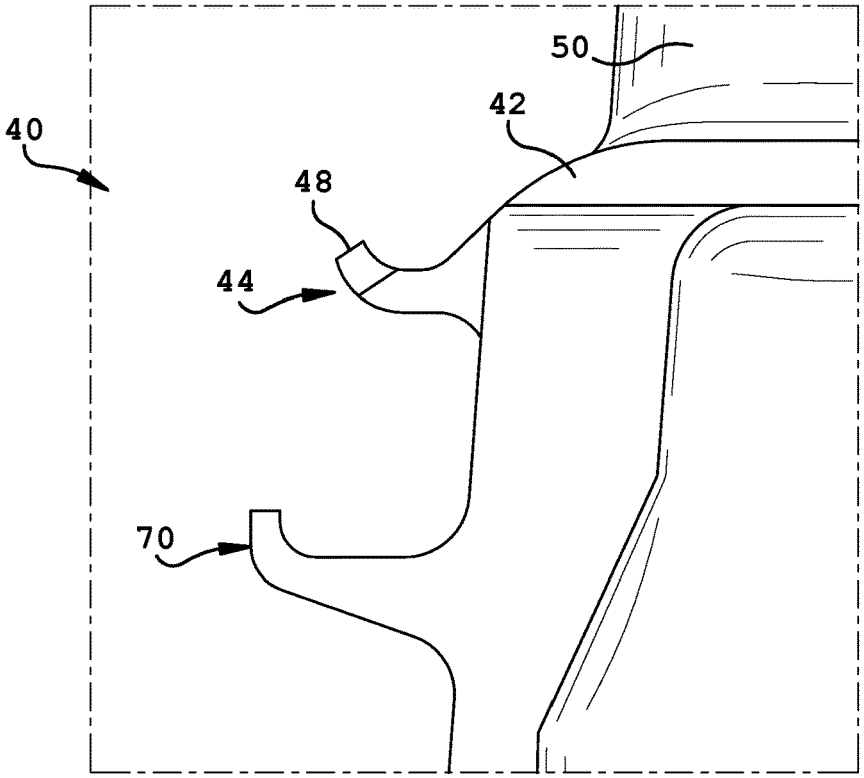
FIG. 3 shows a cross-sectional side view of a portion of a turbine bucket according to an embodiment of the invention.

FIG. 3 shows a cross-sectional side view of a portion of a turbine bucket 40 according to an embodiment of the invention. As can be seen in FIG. 3, a distal end 48 of an arcuate platform lip 44 extends radially outward toward airfoil 50.

Figure 4:
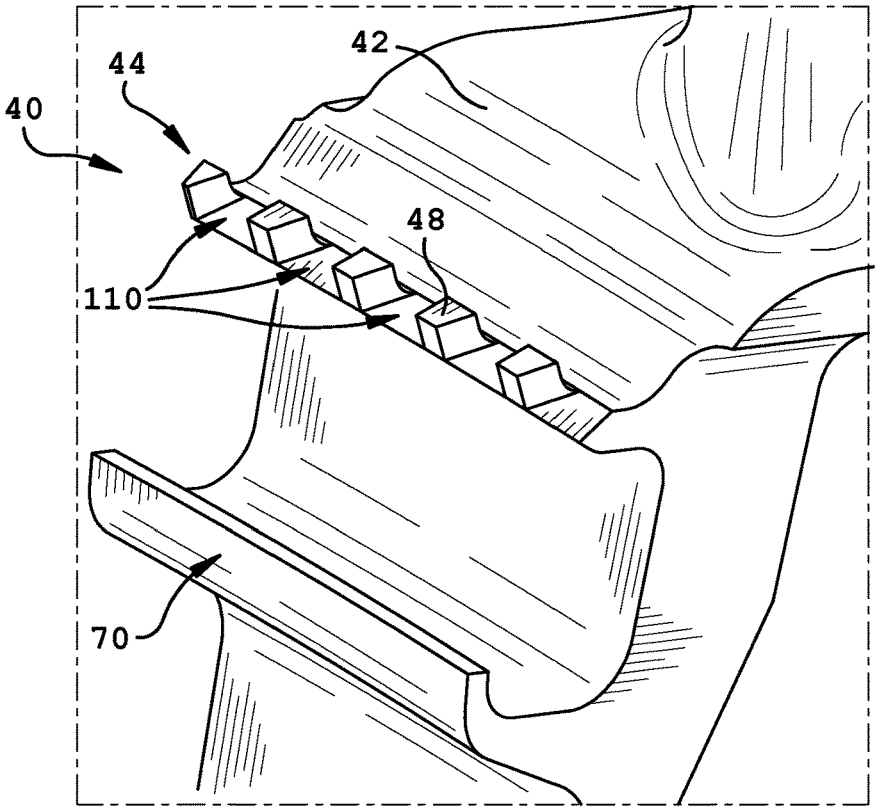
FIG. 4 shows a perspective view of the portion of the turbine bucket of FIG. 3.

FIG. 4 shows a perspective view of the bucket 40 of FIG. 3. A plurality of voids 110 are provided along distal end 48 of platform lip 44. As shown in FIG. 4, voids 110 are substantially trapezoidal in shape and extend to a substantially uniform depth, although this is neither necessary nor essential. Voids having other shapes may also be employed, including, for example, rectangular, rhomboid, or arcuate shapes.

Figure 5:
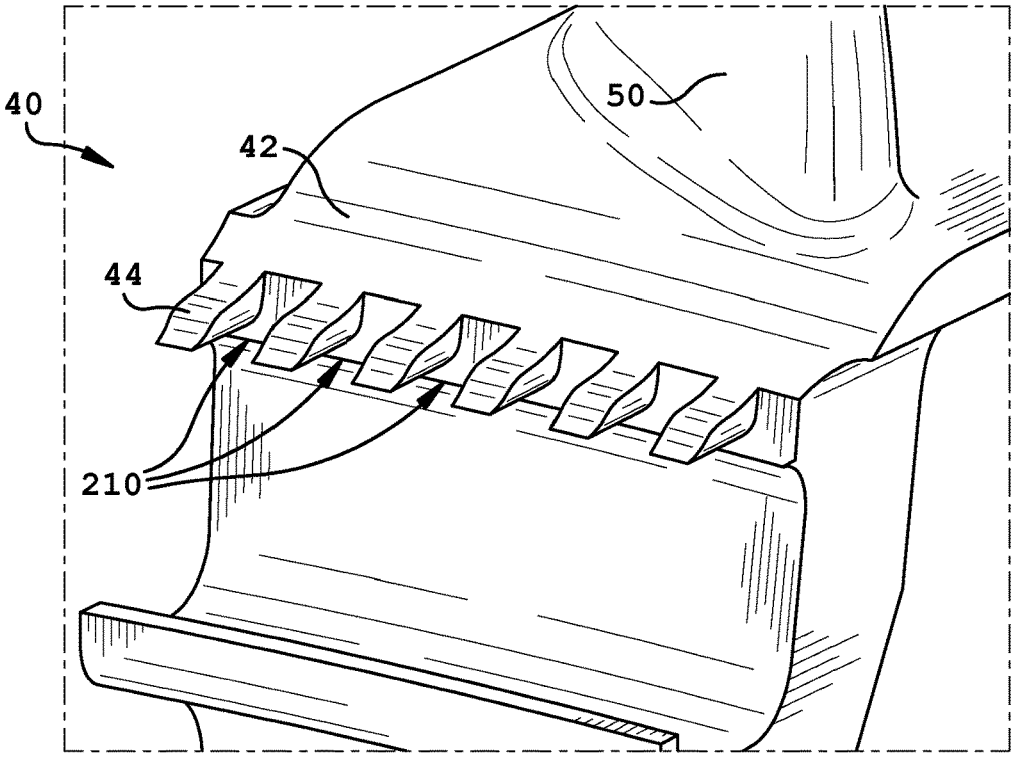
FIG. 5 shows a perspective view of a portion of a turbine bucket according to another embodiment of the invention.

For example, FIG. 5 shows a perspective view of a bucket 40 according to another embodiment of the invention. Here, platform lip 44 extends axially from platform 42 (i.e., a distal end is not angled toward airfoil 50, as in FIGS. 3 and 4). Voids 210 extend through platform lip 44 in an arcuate path such that remaining portions of platform lip 44 adjacent voids 210 include an arcuate face 45.

Figure 6:
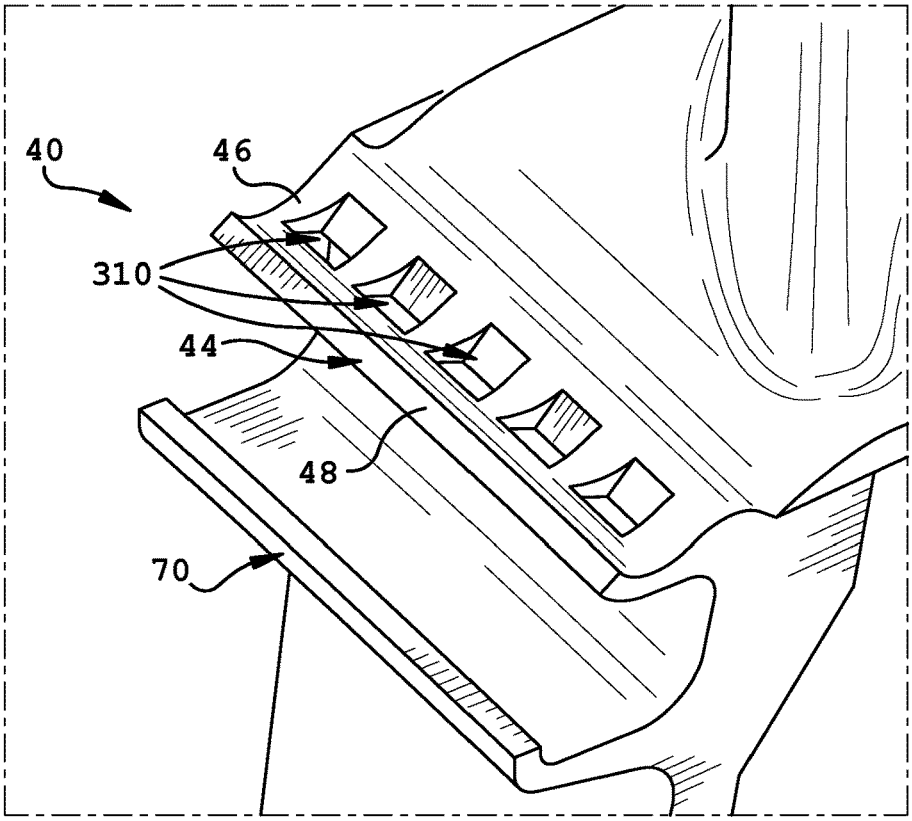
FIG. 6 shows a perspective view of a portion of a turbine bucket according to yet another embodiment of the invention.

The embodiment of the invention shown in FIG. 6 shows a perspective view of bucket 40. Here, platform lip 44 includes an angled distal end 48, as in FIGS. 3 and 4. However, voids 310 are formed in a body 46 of platform lip 44 rather than at its distal end 48. As noted above, voids 310 may take any number of shapes, including, for example, rectangular, trapezoidal, rhomboid, arcuate, etc.

Figure 7:
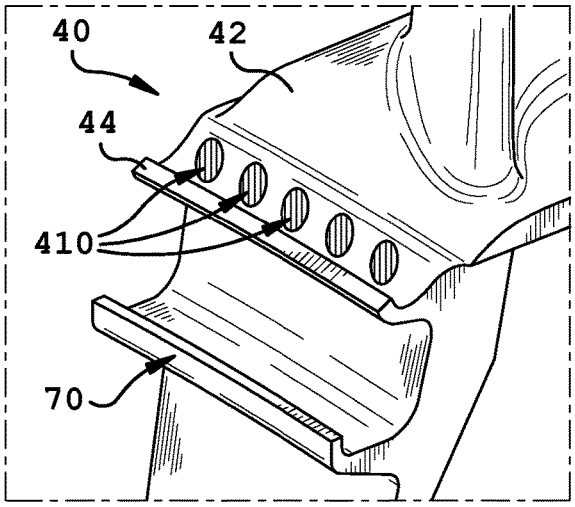
FIGS. 7-13 show perspective views of turbine buckets according to still other embodiments of the invention.
Figure 8:
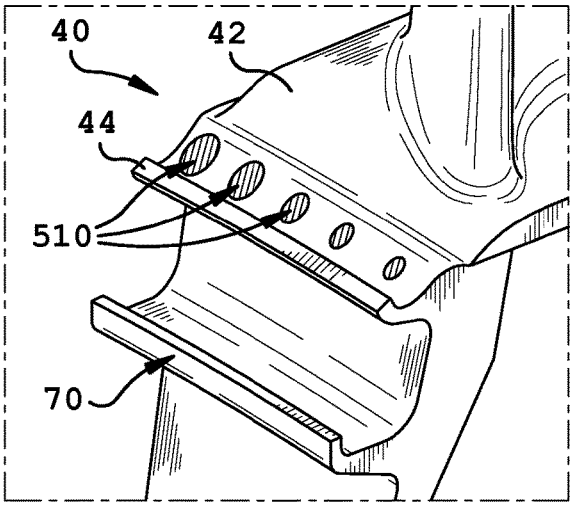
Figure 9:
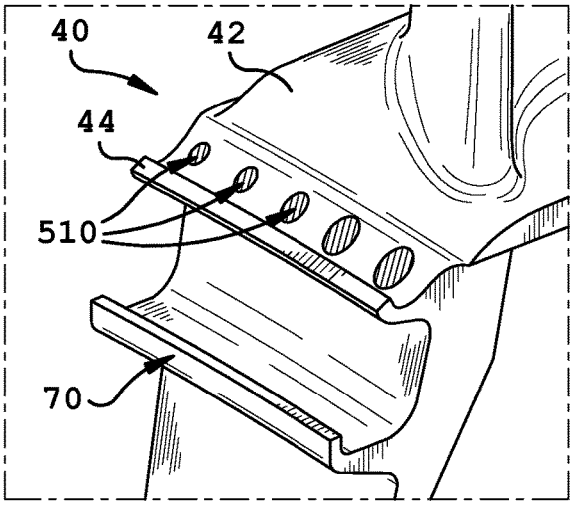

FIGS. 7-9 show perspective views of other embodiments of the invention. In FIG. 7, voids 410 are elliptical in shape and angled with respect to a radial axis of bucket 40.

In FIG. 8, elliptical voids 510 of differing sizes are employed with void size increasing along platform lip 44 from an end nearer the concave trailing face toward the convex leading face of airfoil 50. In such an embodiment, the effect of voids 510 on purge air between platform lip 44 and angel wing 70 will generally be more pronounced adjacent the larger voids. This may be desirable, for example, where a loss of purge air or an incursion of hot gas is greater in the area of the larger voids.

In FIG. 9, elliptical voids 510 of differing size are employed with void size decreasing along platform lip 44 from an end nearer the concave trailing face toward the convex leading face of airfoil 50. As should be recognized from the discussion above, such an embodiment may be desirable, for example, where a loss of purge air or an incursion of hot gas is greater in the area of the larger voids.

FIGS. 10-13 show perspective views of turbine buckets 40 in accordance with various embodiments of the invention. In each of the embodiments in FIGS. 10-13, voids are disposed unevenly along platform lip 44.

Figure 10:
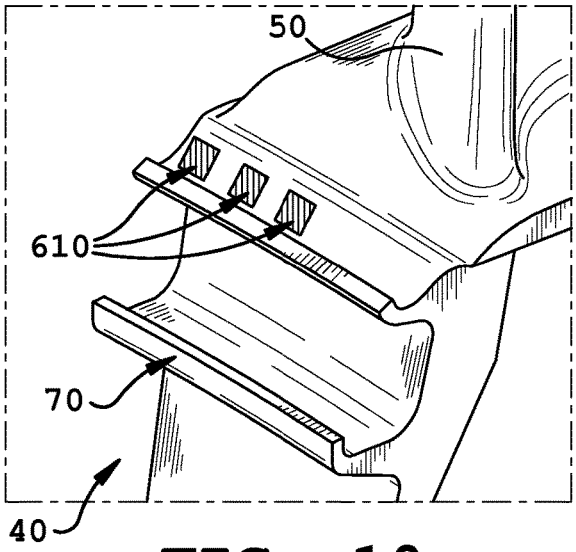

In FIG. 10, a plurality of substantially rectangular voids 610 are disposed along platform lip 44 nearer the convex leading face than the concave trailing face of airfoil 50.

Figure 11:
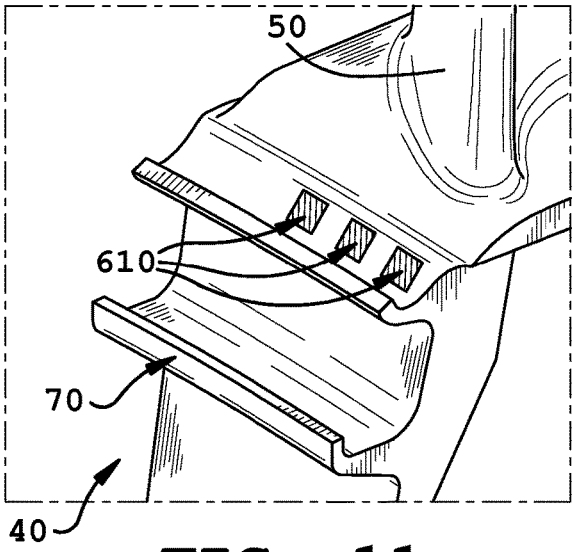

In FIG. 11, the area of void concentration is opposite that in FIG. 10, with the plurality of substantially rectangular voids 610 disposed along platform lip 44 nearer the concave trailing face than the convex leading face of airfoil 50.

Figure 12:
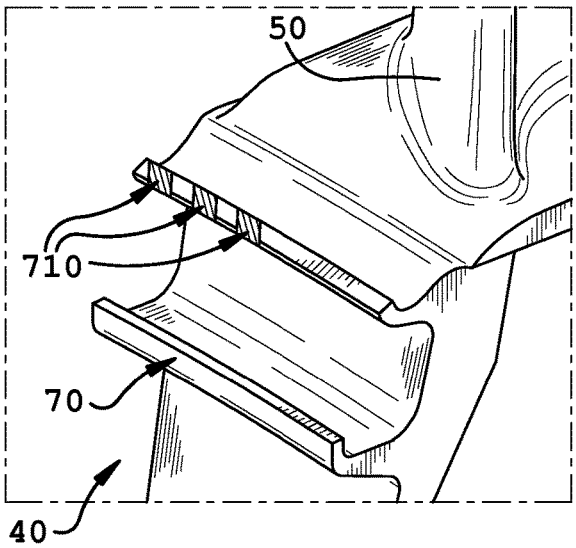
Figure 13:
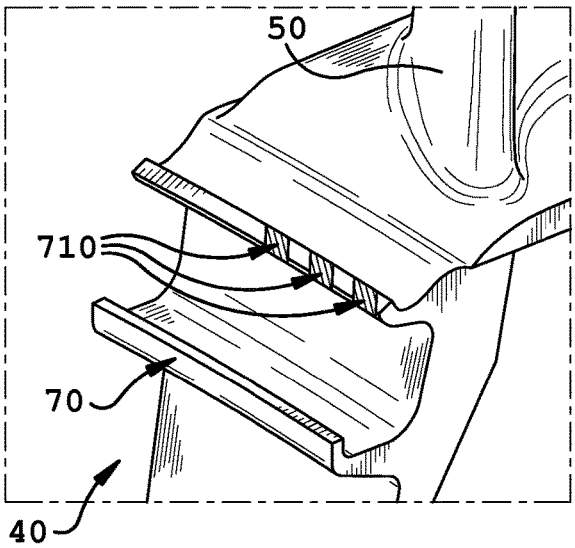

FIGS. 12 and 13 show embodiments similar to those in FIGS. 10 and 11, respectively, in which voids 710 are rhomboid in shape rather than substantially rectangular. The use of rhomboid voids 710 may be employed, for example, to direct purge air toward either convex leading face or concave trailing face of airfoil 50.

Figure 14:
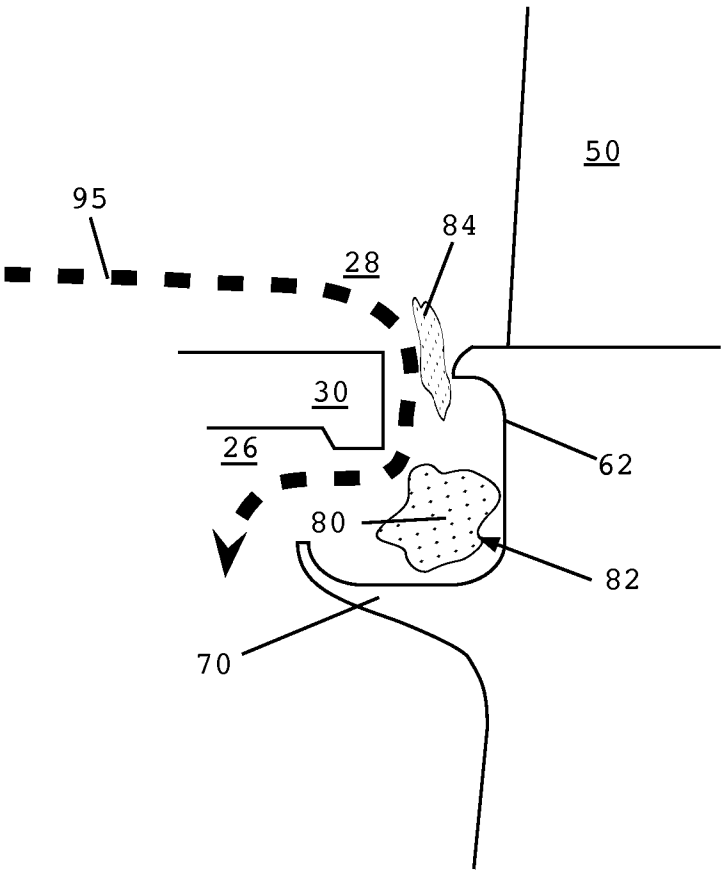
FIG. 14 shows a schematic view of purge air flow in relation to a typical turbine bucket.

FIG. 14 shows a schematic view of purge air flow in a typical turbine bucket. Purge air 80 is shown concentrated and having a higher swirl velocity in area 82, with a significant amount of escaping purge air 84 entering hot gas flowpath 28. The concentration of purge air 80 having a higher swirl velocity in area 82, closer to face 62, allows for incursion of hot gas 95 into wheelspace 26.

Figure 15:
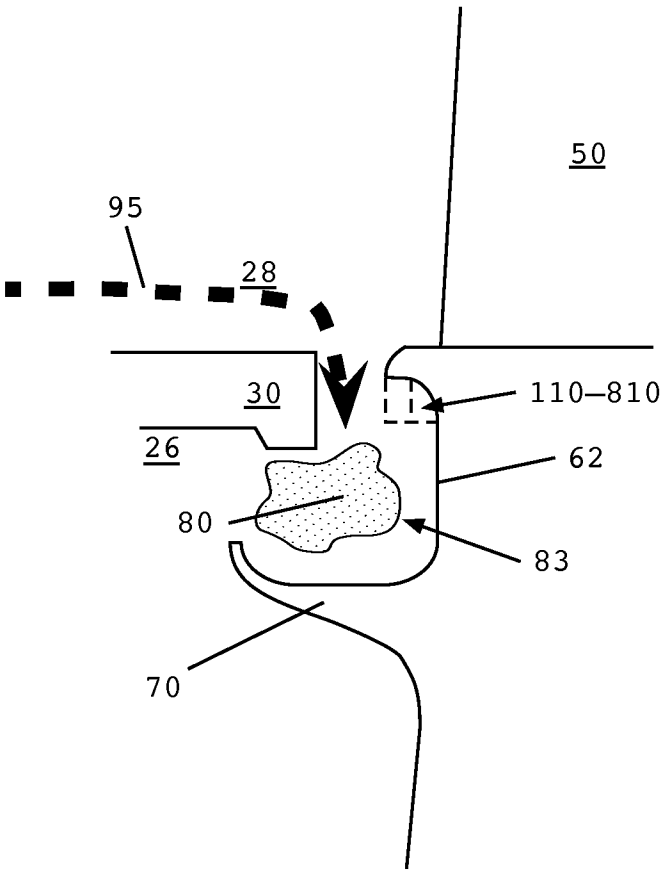
FIG. 15 shows a schematic view of purge air flow in relation to a turbine bucket according to an embodiment of the invention.

In contrast, FIG. 15 shows the effect of voids 110 on purge air 80 according to various embodiments of the invention. As can be seen in FIG. 15, the area 83 in which purge air 80 is concentrated and exhibits a higher swirl velocity is distanced further from face 62 and toward a distal end of platform lip 44, as compared to FIG. 14. This, in effect, produces a curtaining effect, restricting incursion of hot gas 95 from hot gas flowpath 28 while at the same time reducing the quantity of escaping purge air from wheelspace 26 into hot gas flowpath 28.

The increases in turbine efficiencies achieved using embodiments of the invention can be attributed to a number of factors. First, as noted above, increases in swirl velocity reduces the escape of purge air into hot gas flowpath 28, changes in swirl angle reduce the mixing losses attributable to any purge air that does so escape, and the curtaining effect induced by voids according to the invention reduce or prevent the incursion of hot gas 95 into wheelspace 26. Each of these contributes to the increased efficiencies observed.

In addition, the overall quantity of purge air needed is reduced for at least two reasons. First, a reduction in escaping purge air necessarily reduces the purge air that must be replaced. Second, a reduction in the incursion of hot gas 95 into wheelspace 26 reduces the temperature rise within wheelspace 26 and the attendant need to reduce the temperature through the introduction of additional purge air. Each of these reductions to the total purge air required reduces the demand on the other system components, such as the compressor from which the purge air is provided.

While reference above is made to the ability of platform lip voids to change the swirl velocity of purge air within a wheelspace, and particularly within a wheelspace adjacent early stage turbine buckets, it should be noted that platform lip voids may be employed on turbine buckets of any stage with similar changes to purge air swirl velocity and angle. In fact, Applicants have noted a very favorable result when platform lip voids are employed in the last stage bucket (LSB).

Spikes in total pressure ($P_T$) and swirl profiles at the inner radius region of the diffuser inlet are a consequence of a mismatch between the hot gas flow and the swirl of purge air exiting the wheelspace adjacent the LSB. Applicants have found that platform lip voids according to various embodiments of the invention are capable of both increasing $P_T$ spikes at a diffuser inlet close to the inner radius while at the same time decreasing swirl spikes at or near the same location. Each of these improves diffuser performance.

Platform lip voids, for example, have been found to change the swirl angle of purge air exiting the LSB wheelspace by 1-3 degrees while also increasing $P_T$ spikes by 15-30%.

Figure 16:
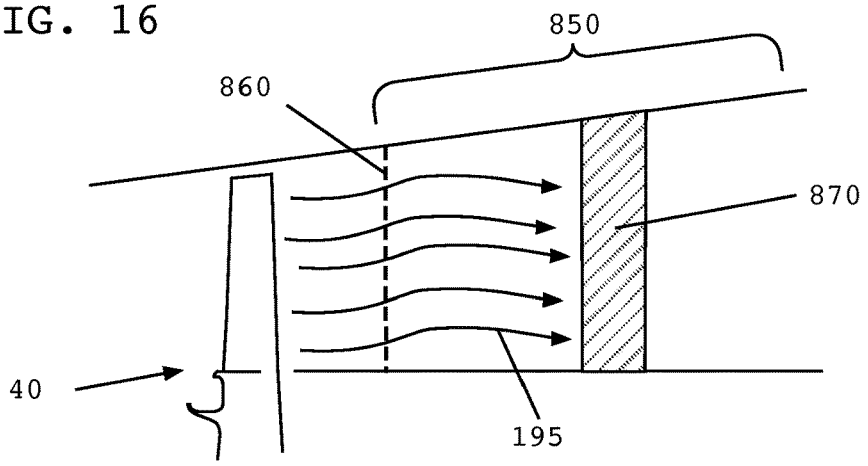
FIG. 16 shows a schematic view of a last stage turbine bucket and diffuser according to an embodiment of the invention.

FIG. 16 shows a schematic view of a LSB 40 adjacent diffuser 850. Hot gas 195 enters diffuser 850 at diffuser inlet plane 860 and passes toward struts 870. Platform lip voids according to embodiments of the invention reduce the swirl mismatch of purge air as it combines with hot gas 195, preventing separation of hot gas 195 as it enters struts 870. At the same time, such platform lip voids increase the $P_T$ spike.

Figure 17:
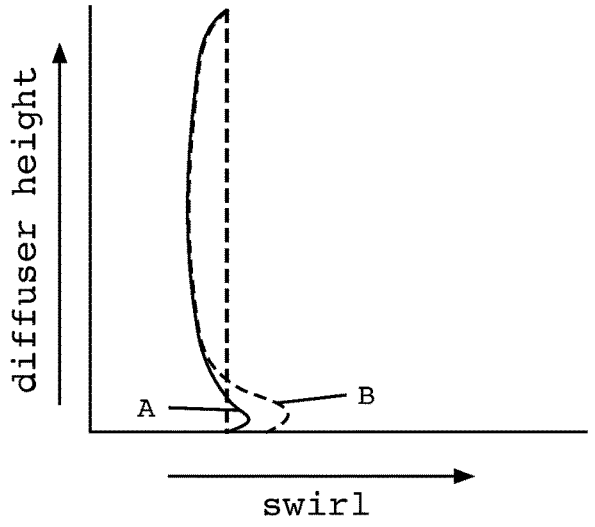
FIG. 17 shows a graph of swirl spike profiles at a diffuser inlet plane for known turbines and turbines according to embodiments of the invention.

FIG. 17 shows a graph of swirl spike as a function of diffuser inlet plane height. Profile A represents a swirl spike profile for a turbine having platform lip voids according to embodiments of the invention. Profile B represents a swirl spike profile for a turbine having a platform lip known in the art. Profile A exhibits a marked decrease in swirl spike at a radially inward position of the diffuser inlet plane.

Figure 18:
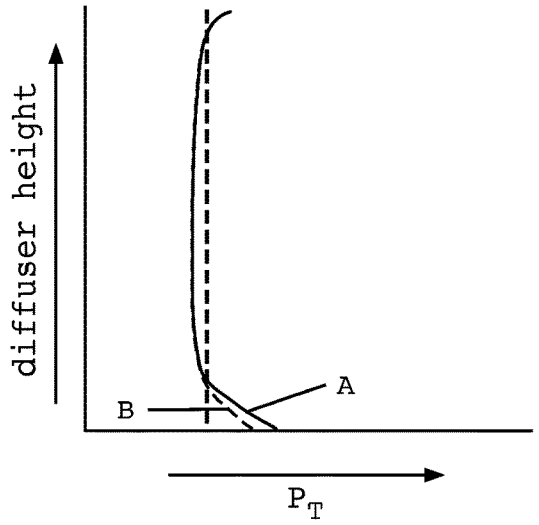
FIG. 18 shows a graph of total pressure spike profiles at a diffuser inlet plane for known turbines and turbines according to embodiments of the invention.

FIG. 18 shows a graph of $P_T$ spike as a function of diffuser inlet plane height. Profile A represents a $P_T$ spike profile for a turbine having platform lip voids according to embodiments of the invention. Profile B represents a $P_T$ spike profile for a turbine having a platform lip known in the art. Profile A exhibits an increase in $P_T$ spike at a radially inward position of the diffuser inlet plane.

Figure 19:
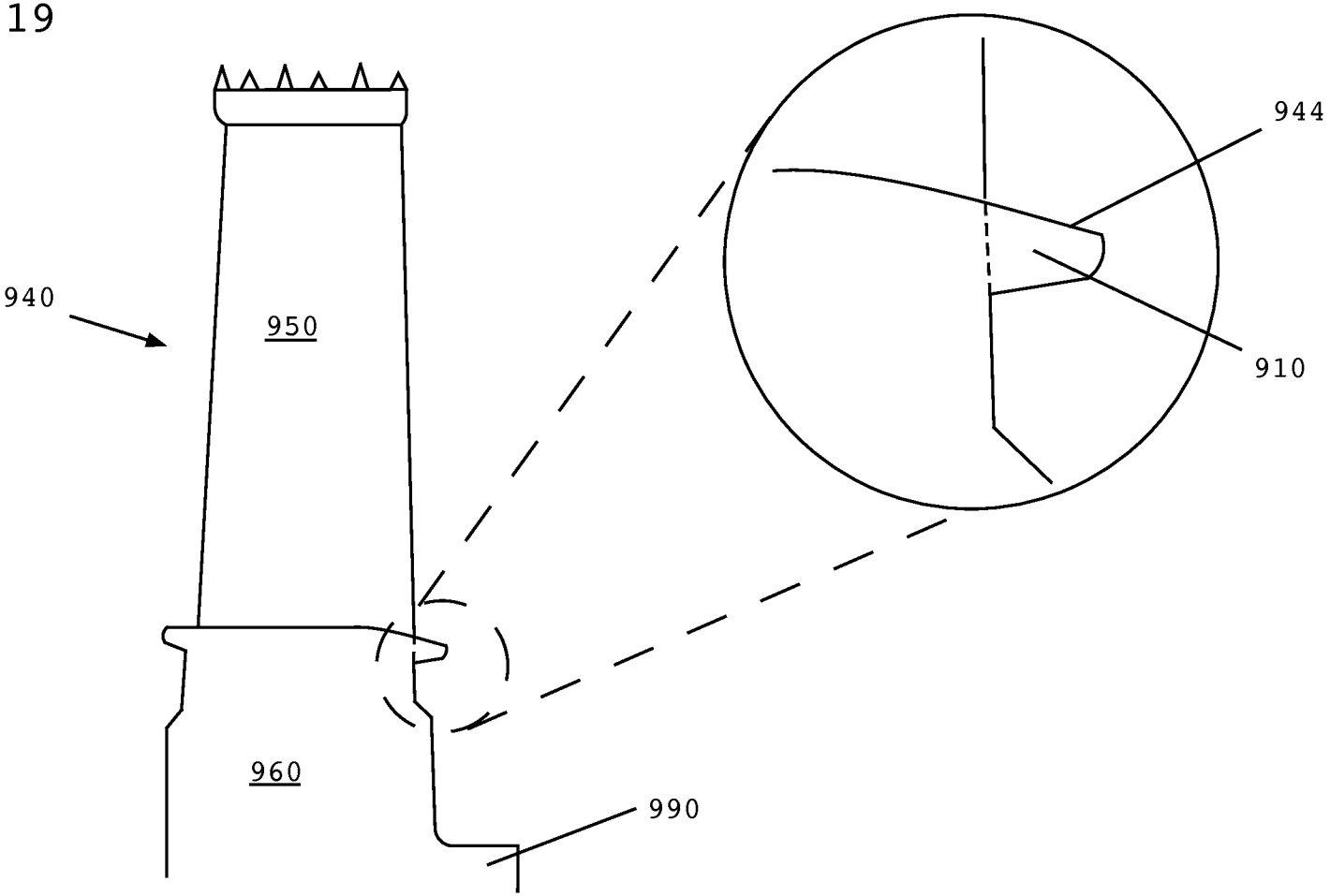
FIG. 19 shows a schematic cross-sectional side view of a steam turbine bucket according to an embodiment of the invention.

The principle of operation of the voids described above may also be applied to the operation of steam turbines. For example, FIG. 19 shows a schematic cross-sectional view of a steam turbine bucket 940 having an airfoil 950 and a shank 960 affixed to a disk 990. A magnified view is provided of platform lip 944, along which voids 910 (shown in phantom) may be deployed similarly to the voids shown in FIGS. 3-5, 12, and 13 above.

Steam turbines employing embodiments of the invention such as those described herein will typically realize improvements in efficiency of between 0.1% and 0.5%, depending, for example, on the leakage flow and the stage at which the features are employed.

As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

This written description uses examples to disclose the invention, including the best mode, and also to enable any person skilled in the art to practice the invention, including making and using any devices or systems and performing any related or incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A turbine bucket comprising:

a platform portion;

a shank portion extending radially inward from the platform portion and at least one angel wing extending axially from a face of the shank portion;

an airfoil extending radially outward from the platform portion;

an arcuate platform lip extending axially from the platform portion, the arcuate platform lip extending outward toward the airfoil to an upturned distal end;

a plurality of column members disposed in spaced relationship along the upturned distal end of the platform lip, wherein each column member consists of a top and four walls joined to the top, and wherein adjacent pairs of the plurality of column members define a plurality of voids therebetween;

the plurality of voids extending to a substantially uniform depth across the walls of the column members that define the voids in circumferential and axial directions;

wherein each wall is substantially perpendicular to the upturned distal end; and wherein, in an operative state, the plurality of voids is adapted to change a swirl velocity of purge air between the platform lip and the at least one angel wing.

2. The turbine bucket of claim 1, wherein at least one of the plurality of voids is axially angled relative to a longitudinal axis of the turbine.

3. The turbine bucket of claim 1, wherein the plurality of voids is unevenly disposed along the surface of the platform lip, wherein the voids are more numerous along one portion of the surface of the platform lip as compared to other areas along the surface of the platform lip.

4. The turbine bucket of claim 1, wherein the plurality of voids is concentrated nearer a leading face of the airfoil than a trailing face of the airfoil.

5. The turbine bucket of claim 1, wherein the plurality of voids is concentrated nearer a trailing face of the airfoil than a leading face of the airfoil.

6. The turbine bucket of claim 1, wherein each of the plurality of voids has a rectangular cross-sectional shape, wherein the voids are substantially perpendicular to a radial direction.

7. The turbine bucket of claim 1, wherein each of the plurality of voids has a trapezoidal cross-sectional shape, wherein the voids are substantially perpendicular to a radial direction.

* * * * *